US012753464B2

(12) United States Patent
Zhang

(10) Patent No.: US 12,753,464 B2
(45) Date of Patent: Oct. 6, 2026

(54) METHOD OF CARBOTHERMIC PROCESS OF MAGNESIUM PRODUCTION AND CO-PRODUCTION OF CALCIUM CARBIDE

(71) Applicant: Zhengzhou University, Zhengzhou City (CN)

(72) Inventor: Shaojun Zhang, Zhengzhou City (CN)

(73) Assignee: Zhengzhou University, Zhengzhou City (CN)

( * ) Notice: Subject to any disclaimer, the term of this patent is extended or adjusted under 35 U.S.C. 154(b) by 481 days.

(21) Appl. No.: 17/786,462

(22) PCT Filed: Dec. 17, 2020

(86) PCT No.: PCT/CN2020/137175
§ 371 (c)(1),
(2) Date: Jul. 19, 2022

(87) PCT Pub. No.: WO2021/121312
PCT Pub. Date: Jun. 24, 2021

(65) Prior Publication Data

US 2023/0049604 A1 Feb. 16, 2023

(30) Foreign Application Priority Data

Dec. 17, 2019 (CN) ..... 201911302508.6

(51) Int. Cl.
*C22B 26/22* (2006.01)
*C22B 1/245* (2006.01)
(Continued)

(52) U.S. Cl.
CPC ..... *C22B 26/22* (2013.01); *C22B 1/245* (2013.01); *C22B 5/10* (2013.01); *C22B 5/16* (2013.01)

(58) Field of Classification Search
None
See application file for complete search history.

(56) References Cited

U.S. PATENT DOCUMENTS 1,650,894 A * 11/1927 Koehler ..... C22B 26/22 75/10.33
2,158,786 A * 5/1939 Kirk ..... C22B 26/22 75/598
(Continued)

FOREIGN PATENT DOCUMENTS

CN 1235645 A 11/1999
CN 101956083 A 1/2011
(Continued)

OTHER PUBLICATIONS

Chubukov et al. Design and Fabrication of Pellets for Magnesium Production by Carbothermal Reduction. Metallurgical and Materials Transactions B. vol. 49B, Oct. 2018. 2209-2218. (Year: 2018).*
(Continued)

*Primary Examiner* — Stephani Hill
(74) *Attorney, Agent, or Firm* — Fitch, Even, Tabin & Flannery, LLP

(57) ABSTRACT

A carbothermic process of magnesium production and co-production of calcium carbide is provided. A mixed powder containing magnesium oxide, calcium oxide and a carbon reducing agent is prepared. The mixed powder is processed into a pelletized furnace feed material, which is placed into a reactor equipped with a heat source. With an absolute pressure P in the reactor being set within the range of 1000 Pa≤P≤atmospheric pressure or to a slightly positive pressure and a reaction temperature T within the range of $11\lg^2P+71\lg P+1210°$ C.<T<$98\lg^2P-129\lg P+1300°$ C., a smelting reaction is run. Liquid magnesium is obtained through condensation by a condenser connected to the reactor, and after the smelting reaction has finished, calcium carbide is obtained within the reactor.

8 Claims, 3 Drawing Sheets

(51) Int. Cl.
*C22B 5/10* (2006.01)
*C22B 5/16* (2006.01)

(56) References Cited

U.S. PATENT DOCUMENTS

| | | | | | |
|---|---|---|---|---|---|
| 2,208,586 | A | * | 7/1940 | Kemmer | C22B 26/22 75/596 |
| 2,323,597 | A | * | 7/1943 | Hansgirg | C22B 26/22 75/597 |
| 2,920,951 | A | * | 1/1960 | Bretschneider | C22B 5/16 75/658 |
| 3,849,118 | A | * | 11/1974 | Mod | C22B 5/04 75/597 |
| 4,015,978 | A | * | 4/1977 | Matsushima | C22B 26/22 75/316 |
| 4,238,224 | A | | 12/1980 | Bettanini et al. | |
| 4,437,886 | A | * | 3/1984 | Miura | C22B 26/22 75/10.33 |
| 5,782,952 | A | | 7/1998 | Diaz et al. | |
| 2009/0121397 | A1 | * | 5/2009 | Wong | C22B 19/14 266/171 |

FOREIGN PATENT DOCUMENTS

| | | | | | |
|---|---|---|---|---|---|
| CN | 101967566 | A | | 2/2011 | |
| CN | 101985701 | A | | 3/2011 | |
| CN | 102041398 | A | | 5/2011 | |
| CN | 201942729 | U | | 8/2011 | |
| CN | 107083491 | A | * | 8/2017 | C22B 5/10 |
| CN | 107083491 | B | | 8/2017 | |
| CN | 107541608 | A | | 1/2018 | |
| CN | 107857267 | A | | 3/2018 | |
| GB | 482157 | A | | 3/1938 | |

OTHER PUBLICATIONS

Mauderli et al. Thermodynamics of the reduction of MgO by C and by CaC2. Helvetic Chimica Acta (1944) 27, 105-116. (Year: 1944).*

Patent Cooperation Treaty, International Search Report for International Application No. PCT/CN2020/137175 dated Mar. 17, 2021 and English Translation, 6 pages.

Patent Cooperation Treaty, Written Opinion of the International Searching Authority for International Application No. PCT/CN2020/137175 dated Mar. 17, 2021 in Chinese, 3 pages.

He Yantao, and Zhou Weidong, Synthesis of low-temperature reaction of calcium carbide, Petrochemical Industrial Application, vol. 29, No. 10, Oct. 2010, pp. 6-10, English Abstract.

Liu Siyuan et al., Thermodynamical Analysis and Experimental Test of Calcium Carbide Synthesis, Coal Conversion, vol. 40, No. 5, Sep. 2017, pp. 74-80, English Absdtract.

Wang Yuchao et al., Thermodynamic Analysis of Mg Extraction from Calcined Dolomite by Carbothermic Reduction in Vacuum, Chinese Journal of Vacuum Science and Technology, vol. 33, No. 11, 2013, with English Abstract.

* cited by examiner

METHOD OF CARBOTHERMIC PROCESS OF MAGNESIUM PRODUCTION AND CO-PRODUCTION OF CALCIUM CARBIDE

CROSS-REFERENCE TO RELATED APPLICATIONS

This application is a U.S. national phase application filed under 35 U.S.C. § 371 of International Application Number PCT/CN2020/137175, filed Dec. 17, 2020, designating the United States, which claims priority from Chinese Patent Application Number 201911302508.6, filed Dec. 17, 2019.

FIELD OF THE INVENTION

The present invention relates to the field of metallurgy and, in particular, to a method of carbothermic process of magnesium production and co-production of calcium carbide.

DESCRIPTION OF THE PRIOR ART

In the current industrial practice, magnesium is commonly produced in a silicothermic or electrolytic manner. Silicothermic magnesium production relies on the reduction reaction $2(MgO{\cdot}CaO)_{(s)}+Si_{(s)}\rightarrow 2Mg_{(g)}+2CaO{\cdot}SiO_{2(s)}$ that occurs at a high temperature under vacuum, with calcined dolomite (or dolime, for short, with MgO·CaO as an active ingredient) being used as a raw material and ferrosilicon (with Si as an active ingredient) as a reducing agent. The resulting solid waste $2CaO{\cdot}SiO_2$ is substantially useless and is usually disposed by landfill. Electrolytic magnesium production relies on the reaction $MgCl_{2(l)}\rightarrow Mg_{(l)}+Cl_{2(g)}$ which is conducted in an electrolytic cell, with molten magnesium chloride being used as a raw material. The resulting waste gas $Cl_2$ is toxic and hazardous. Integrated utilization (harmless disposal) of the chlorine gas requires a complex and lengthy process.

A carbothermic approach utilizes dolime (MgO·CaO) or calcined magnesite (MgO) as a raw material and carbon as a reducing agent and involves running the reduction reaction $MgO{\cdot}CaO_{(s)}+C_{(s)}\rightarrow Mg_{(g)}+CO_{(g)}+CaO_{(s)}$ or $MgO_{(s)}+C_{(s)}\rightarrow Mg_{(g)}+CO_{(g)}$ at a high temperature under vacuum. As a reducing agent, carbon is significantly lower in cost than the ferrosilicon used in silicothermic magnesium production. Moreover, the resulting waste gas CO can be used as fuel. In particular, no solid waste will be produced in case of calcined magnesite being used as the raw material, and the solid waste CaO produced in case of dolime being used as the raw material is of certain utility value. Therefore, carbothermic magnesium production is commonly considered to be considerably advantageous in terms of economics.

However, carbothermic magnesium production is associated with two overwhelming disadvantages. One of the disadvantages is that the produced magnesium in the form of a vapor, when co-cooled with the CO gas, will condense into a magnesium powder. This high-temperature magnesium powder is a huge potential safety hazard because it will lead to a violent explosion when exposed to air. The other disadvantage is that, during co-cooling of the magnesium vapor with the CO gas, the reverse reaction $Mg_{(g)}+CO_{(g)}\rightarrow MgO_{(s)}+C_{(s)}$ to the producing reaction will take place. This reverse reaction will lead to not only a lower reduction rate of the smelting reaction but also a significantly reduced purity of the crude magnesium.

For long, domestic and foreign researchers have devoted their studies to solving the above two problems associated with carbothermic magnesium production. However, to date, effective solutions remain absent. Consequently, the carbothermic approach has not been employed in industrial applications. In July 2016, the Australian Commonwealth Scientific and Industrial Research Organization announced a new carbothermic technique for magnesium production, in which a mixed gas of a magnesium vapor and CO was driven through a specially designed "supersonic nozzle" (de Laval nozzle) at 4 times the speed of sound, and as a result of passing through the nozzle, the magnesium vapor "instantaneously" condensed into solid crystalline magnesium. In this way, the formation of a magnesium powder can be avoided, and reversing of the reaction can be mitigated. However, there have been no reports about its industrial application so far.

Chinese Patent Application No. 201710320876.8, entitled "Process for Joint Production of Metal Magnesium and Calcium Acetylide Using Carbothermic Method", teaches producing magnesium together with calcium acetylide by using dolime as a raw material and combining the reaction $MgO{\cdot}CaO+C\rightarrow Mg+CO+CaO$ for carbothermic magnesium production with the smelting reaction $CaO+3C\rightarrow CaC_2+CO$ for calcium acetylide ($CaC_2$) production. However, in this process, there is still co-existence of a magnesium vapor and a CO gas, so the two major problems associated with carbothermic magnesium production, i.e., a potential safety hazard of the formation of a magnesium powder and reversing of the production reaction, remain unsolved. Moreover, a large number of experiments conducted in Zhengzhou University and by many researchers have proved that at an absolute pressure (referred to hereinafter as "AP" or the pressure for short) in the range of 10-100 Pa and a temperature in the range of 1500-1800° C., as taught in Application No. 201710320876.8, both the reactions $MgO{\cdot}CaO+C\rightarrow Mg+CO+CaO$ and $CaO+3C\rightarrow CaC_2+CO$ proceed at a very low rate, making it of little value to industrial applications. As founded in the experiments, after several hours of the reactions running at 1500-1600° C., in a single material pellet weighing tens of grams, only a trace amount of calcium carbide was detected in the solid-phase product (sometimes, even almost no calcium carbide was detected). After several hours of the reactions running at 1700° C. or a higher temperature, although the formation of calcium carbide could be confirmed in the solid-phase product, the product (CaO and $CaC_2$) showed a considerably lower Ca content compared to the raw material, indicating that part of Ca in the raw material is lost in a gaseous form by evaporation. Some literature reports on similar phenomena can be found in: (1) Study on Low-Temperature Calcium Acetylide Synthesis Reaction and Its Catalytic Mechanism, He Yantao, et al., Petrochemical Industry Application, Vol. 29, No. 10; (2) Thermodynamic Analysis and Experimental Validation of Low-Temperature Synthesis of Calcium Carbide, Liu Siyuan, et al., Coal Conversion, Vol. 40, No. 5.

SUMMARY OF THE INVENTION

In view of this, the inventors have conducted a lot of experiments and calculations, and the results show (see FIG. 1) that a mixture of dolime (MgO·CaO) and C will undergo the following sequence of reactions at a high-temperature vacuum reactor:

1. First of all, the reaction $MgO{\cdot}CaO_{(s)}+C_{(s)}\rightarrow Mg_{(g)}+CO_{(g)}+CaO_{(s)}$ (referred to as "Reaction 1") occurs at a temperature higher than Curve (1), producing a Mg vapor and CaO. A relationship between the temperature T (° C.) and the absolute pressure P (Pa) for Curve (1) is given by $T=20\ \lg^2P+60\ \lg P+1050$.

2. Next, if the temperature is higher than Curve (2), the CaO resulting from "Reaction 1" further undergoes the reaction $CaO_{(s)}+3C_{(s)}\rightarrow CaC_{2(s)}+CO_{(g)}$ ("Reaction 2") with C, which consumes the CaO and produces $CaC_2$. A relationship between the temperature T (° C.) and the absolute pressure P (Pa) for Curve (2) is given by $T=1\ \lg^2P+71\ \lg P+1210$.

3. Subsequently, if the temperature is higher than Curve (3), the $CaC_2$ resulting from "Reaction 2" further undergoes the reaction $MgO{\cdot}CaO_{(s)}+CaC_{2(s)}\rightarrow Mg_{(g)}+2C_{(s)}+2CaO_{(s)}$ ("Reaction 3") with the dolime remaining from "Reaction 1". As a result, the $CaC_2$ is consumed to result in vaporous Mg, and CaO is again produced, and "Reaction 3" takes place much more easily than "Reaction 1" and "Reaction 2". That is, before magnesium oxide in the dolime is completely reduced into vaporous Mg, there will be almost no $CaC_2$ in the reaction system. A relationship between the temperature T (° C.) and the absolute pressure P (Pa) for Curve (3) is given by $T=51\ \lg^2P-38\ \lg P+800$.

4. After magnesium oxide in the dolime has been completely reduced into vaporous Mg, if the temperature remains higher than Curve (2), Reaction 2 will continue to take place to produce $CaC_2$. If the temperature is further higher than Curve (4), the resulting $CaC_2$ will further undergo the reaction $2CaO_{(s)}+CaC_{2(s)}\rightarrow^{3}Ca_{(g)}+2CO_{(g)}$ ("Reaction 4") with the remaining CaO in the system, thus additionally consuming $CaC_2$ and producing a Ca vapor. A relationship between the temperature T (° C.) and the absolute pressure P (Pa) for Curve (4) is given by $T=30\ \lg^2P+58\ \lg P+1215$.

5. At last, if the Ca vapor resulting from "Reaction 4" comes into contact with C that is at a temperature lower than (notably, here, not "higher than") Curve (5) in the reaction system, the exothermic reaction $Ca_{(g)}+2C_{(s)}\rightarrow CaC_{2(s)}$ ("Reaction 5") will take place, again producing $CaC_2$. If the Ca vapor does not come into contact with C that is at a temperature lower than Curve (5), Reaction 5 will not occur, and the Ca vapor has to be discharged from the reaction system. A relationship between the temperature T (° C.) and the absolute pressure P (Pa) for Curve (5) is given by $T=98\ \lg^2P-129\ \lg P+1300$.

As can be seen from FIG. 1, at an absolute pressure of 10-100 Pa and a temperature of 1500-1800° C., as taught in Application No. 201710320876.8, Reactions 1 to 4 as described above will all occur, but Reaction 5 will not. That is, the $CaC_2$ resulting from Reaction 2 will be consumed by Reaction 3 and Reaction 4, and the more complete the reactions are, the thoroughly the $CaC_2$ will be consumed. In particular, since the Ca vapor produced by Reaction 4 cannot be converted again into $CaC_2$ by Reaction 5, Ca has to be discharged from the reaction system and lost in vain in the vaporous form (as can be seen from FIG. 4, Ca is vaporized at a temperature of about 500-600° C. at an absolute pressure ranging from 10 Pa to 100 Pa). Additionally, as can be seen from FIG. 1, at an absolute pressure of 10-100 Pa, Curve (2) and Curve (4) are close to each other. That is, Reaction 2 and Reaction 4 start at similar temperatures and it is difficult to allow the occurrence of only Reaction 2 that produces $CaC_2$ but not Reaction 4 that reduces $CaC_2$ to vaporous Ca. Moreover, Curve (5) and Curve (4) are also close to each other. That is, after $CaC_2$ is reduced to a Ca vapor, it is difficult for the Ca vapor to further undergo Reaction 5 with C to produce $CaC_2$. Therefore, the Ca vapor has to be discharged from the reaction system in vain. Consequently, the whole process is equivalent to the occurrence of the combined (overall) reaction of Reaction 2 and Reaction 4: $CaO_{(s)}+C_{(s)}\rightarrow Ca_{(g)}+CO_{(g)}$. Finally, a noticeable amount of $CaC_2$ will not be produced if the reaction proceeds completely, and only a small amount of $CaC_2$ that co-exists with CaO will be produced if the reaction is incomplete.

In view of the above-described drawbacks of the prior art, the present invention provides a method of carbothermic process of magnesium production and co-production of calcium carbide, which solves some or all above problems. In One Aspect, the Present Invention Provides a Method of Carbothermic Process of Magnesium Production and Co-Production of Calcium Carbide, Comprising the Steps of:

S1: preparing a mixed powder containing magnesium oxide, calcium oxide and a carbon reducing agent;

S2: processing the mixed powder into a pelletized furnace feed material and placing it into a reactor equipped with a heat source; and S3: with an absolute pressure P in the reactor being set within a range of 1000 Pa≤P≤atmospheric pressure or to a slightly positive pressure and a reaction temperature T within a range of $11\ \lg^2P+71\ \lg P+1210$° C.<T<$98\ \lg^2P-129\ \lg P+1300$° C., running a smelting reaction, and obtaining liquid magnesium through condensation by a condenser connected to the reactor and calcium carbide within the reactor.

In some embodiments, preferably, in the mixed powder, a molar content $M_C$ of the carbon reducing agent, a molar content $M_{MgO}$ of the magnesium oxide and a molar content $M_{CaO}$ of the calcium oxide are in a relationship of: $M_C \approx M_{MgO}+3M_{CaO}$.

In some embodiments, preferably, the mixed powder has a degree of fineness of 80 mesh or greater, more preferably, 100 mesh.

In some embodiments, preferably, the pelletized furnace feed material has an equivalent diameter of 20 mm to 40 mm.

In some embodiments, preferably, an outer layer of the reactor is a hermetic container provided therein with a smelting chamber, with a thermal insulation layer being disposed between the hermetic container and the smelting chamber. The hermetic container is not directly heated. Instead, it serves to seal and isolate an internal smelting environment in the reactor from outside air. The pelletized furnace feed material is placed within the smelting chamber. The smelting chamber is constructed from components of a high-temperature resistant material that is resistant to a temperature at least higher than 1700° C. and is preferred to be graphite, silicon carbide, molybdenum disilicide, tungsten, tungsten alloy, molybdenum, molybdenum alloy, high-temperature resistant ceramic or the like.

In some embodiments, preferably, a heating manner of the heat source for heating the smelting chamber in the reactor is electric heating. Other heating manners such as electromagnetic induction heating, resistive heating, electric arc heating are also possible. Moreover, preferably, the smelting chamber itself can be energized to serve as an electric heating element.

In some embodiments, optionally, the carbon reducing agent is one of coke, semi-coke, coal, petroleum coke, coal tar, graphite, asphalt and other carbon-based materials, or a mixture of any two or more of the above mixed in any ratio.

In some embodiments, optionally, the mixed powder may be prepared directly from dolime and the carbon reducing agent.

In some embodiments, optionally, different ratios of the magnesium oxide to the calcium oxide in the mixed powder result in different ratios of the magnesium to the calcium carbide.

In a Second Aspect, the Present Invention Also Provides a Method of Carbothermic Process of Calcium Production and Co-Production of Calcium Carbide, Comprising the Steps of:

S1: preparing a mixed powder containing calcium oxide and a carbon reducing agent;

S2: pressing the mixed powder into a pelletized furnace feed material and placing it into a reactor equipped with a heat source; and S3: with an absolute pressure P in the reactor being set within a range of 10000 Pa≤P≤atmospheric pressure or to a slightly positive pressure and a reaction temperature as $T>30\ \lg^2P+58\ \lg P+1215°$ C., running a smelting reaction, and obtaining liquid calcium through condensation by a condenser connected to the reactor and calcium carbide within the reactor.

In some embodiments, optionally, a molar ratio of the calcium oxide to the carbon reducing agent in the mixed powder is as CaO:C≈1:3-1:1. Different CaO/C ratios will result in different ratios of the calcium to the calcium carbide. Optionally, the mixed powder is prepared with the molar ratio CaO:C≈1:1. After the smelting reaction proceeds completely, the only products are liquid calcium and CO. Apart from impurity residue, substantially no calcium carbide is produced. Optionally, the mixed powder is prepared with the molar ratio CaO:C≈1:3 and the reaction temperature T in step S3 being set in the range of $11\ \lg^2P+71\ \lg P+1210°$ C.$<T<98\ \lg^2P-129\ \lg P+1300°$ C., after the smelting reaction proceeds completely, the only products are calcium carbide and CO, and substantially no liquid calcium is produced.

In a Third Aspect, the Present Invention Also Provides a Method of Carbothermic Process of Magnesium Production and Co-Production of Calcium Carbide Using Solid-Phase Calcium Carbide as a Catalyst, Comprising the Steps of:

S1: preparing a mixed powder containing magnesium oxide, calcium oxide, a carbon reducing agent and a calcium carbide catalyst;

S2: processing the mixed powder into a pelletized furnace feed material and placing it into a reactor equipped with a heat source;

S3: with an absolute pressure P in the reactor being set within a range of 1000 Pa≤P≤atmospheric pressure and a reaction temperature T within a range of $51\ \lg^2P-38\ \lg P+800°$ C.$<T<20\ \lg^2P+60\ \lg P+1050°$ C., running a smelting reaction for magnesium, and obtaining liquid magnesium through condensation by a condenser connected to the reactor; and S4: after the smelting reaction for magnesium in S3 has finished, with an absolute pressure P in the reactor being set within a range of 1000 Pa≤P≤atmospheric pressure or to a slightly positive pressure and a reaction temperature T within a range of $11\ \lg^2P+71\ \lg P+1210°$ C.$<T<98\ \lg^2P-129\ \lg P+1300°$ C., running a smelting reaction for calcium carbide, and obtaining calcium carbide within the reactor.

In some embodiments, preferably, in the mixed powder, a molar content $M_{MgO}$ of the magnesium oxide, a molar content $M_{CaO}$ of the calcium oxide, a molar content $M_{CaC2}$ of the calcium carbide and a molar content $M_C$ of the carbon reducing agent are in relationships of: $M_{MgO}\approx M_{CaC2}$ and $M_C\approx M_{MgO}+3M_{CaO}$.

In some embodiments, optionally, the mixed powder may be prepared directly from dolime, the calcium carbide catalyst and the carbon reducing agent.

In some embodiments, optionally, different ratios of the magnesium oxide to the calcium oxide in the mixed powder result in different ratios of the magnesium to the calcium carbide.

In a Fourth Aspect, the Present Invention Also Provides a Method of Carbothermic Process of Magnesium Production and Co-Production of Calcium Carbide Using Liquid-Phase Calcium Carbide as a Catalyst, Comprising the Steps of:

S1: preparing a granular raw material containing magnesium oxide and calcium oxide and a granular carbon reducing agent;

S2: placing a calcium carbide catalyst into a reactor equipped with a heat source and heating and melting the calcium carbide so that it in a molten state forms a catalyst melt pool;

S3: a) mixing the granular raw material containing the magnesium oxide and the calcium oxide with the granular carbon reducing agent and adding them to the catalyst melt pool to form a solid-phase material layer with a certain thickness over a surface of the catalyst melt pool; or b) first, laying a layer of the granular raw material containing the magnesium oxide and the calcium oxide over a surface of the catalyst melt pool to form a first raw material layer, then laying a layer of the granular carbon reducing agent over the first raw material layer to form a first reduction layer, and following this order to stack sequentially a number of such layers; and S4: with an absolute pressure P in the reactor being set within a range of 1000 Pa≤P≤atmospheric pressure or to a slightly positive pressure and a melt pool temperature T within a range of 1900° C.≤T≤$30\ \lg^2P+58\ \lg P+1215°$ C., running a smelting reaction, during the reaction, through adjusting a thickness of the material layer in S3, causing a magnesium vapor to continually pass through the material layer and leave the material layer at a cooled temperature higher than a condensation temperature of the magnesium vapor $T_b=21.4\ \lg^2P+18.4\ \lg P+437°$ C., and obtaining liquid magnesium through condensation by a condenser connected to the reactor.

In some embodiments, preferably, in all the material layer in S3, a molar content $M_C$ of the carbon reducing agent, a molar content $M_{MgO}$ of the magnesium oxide and a molar content $M_{CaO}$ of the calcium oxide are in a relationship of $M_C\approx M_{MgO}+3M_{CaO}$.

In some embodiments, preferably, the granular raw material and the granular carbon reducing agent have sizes of 5 mm to 100 mm.

In some embodiments, preferably, an outer layer of the reactor is a hermetic container provided therein with a smelting chamber, with a thermal insulation layer being disposed between the hermetic container and the smelting chamber. The hermetic container is not directly heated. Instead, it serves to seal and isolate an internal smelting environment in the reactor from outside air. The calcium carbide catalyst melt pool is placed within the smelting chamber. The smelting chamber is constructed from components of a high-temperature resistant material that is resistant to a temperature at least higher than 1900° C. and is preferred to be graphite.

In some embodiments, optionally, the raw material containing the magnesium oxide and the calcium oxide may be prepared directly from dolime.

In some embodiments, optionally, different ratios of the magnesium oxide to the calcium oxide in the granular raw material result in different ratios of the magnesium to the calcium carbide.

In a Fifth Aspect, the Present Invention Also Provides a Method of Carbothermic Process of Metal Production Using Solid-Phase Calcium Carbide as a Catalyst, Comprising the Steps of:

S1: preparing a mixed powder containing a metal oxide $M_mO$, a carbon reducing agent and the calcium carbide catalyst, wherein the metal M in the metal oxide $M_mO$ is Mg, Pb, Sn, Zn, Fe, Mn, Ni, Co, Cr, Mo or V, and m is an atomic number ratio of metal element M to oxygen element O and m≤1;

S2: processing the mixed powder into a pelletized furnace feed material and placing it into a reactor equipped with a heat source;

S3: with an absolute pressure P in the reactor being set within a low vacuum range higher than a triple-point pressure of the metal M and a reaction temperature T to be higher than a temperature at which a reaction

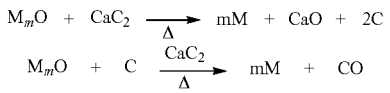

$$M_mO + CaC_2 \xrightarrow[\Delta]{} mM + CaO + 2C$$

$$M_mO + C \xrightarrow[\Delta]{CaC_2} mM + CO$$

begins at the absolute pressure P and lower than a temperature at which a reaction begins at the absolute pressure P (the triple point pressures of the metals and the temperatures at which the respective reactions begin can be calculated according to the method described in A Practical Handbook of Inorganic Thermodynamic Data, $2^{nd}$ Edition, pp. 1-25, by Ye Dalun, from relevant data given in this handbook), running a smelting reaction for the metal M, and obtaining a simple substance of the metal M through condensation by a condenser connected to the reactor; and S4: after the smelting reaction for the metal M in S3 has finished, with the absolute pressure P in the reactor being set within a low vacuum range higher than the triple-point pressure of the metal M or to atmospheric pressure or a slightly positive pressure and a reaction temperature T within a range of 11 $lg^2P$+71 lgP+1210° C.<T<98 $lg^2P$−129 lgP+1300° C., running a smelting reaction for calcium carbide, and after the reaction has finished, obtaining calcium carbide within the reactor.

In some embodiments, preferably, a molar ratio of the metal oxide $M_mO$ to the calcium carbide to the carbon reducing agent contained in the mixed powder is $M_mO$:$CaC_2$:C≈1:1:1.

In some embodiments, preferably, when the metal oxide is magnesium oxide, in S3, with the absolute pressure P in the reactor being set within a low vacuum range of 1000 Pa≤P≤atmospheric pressure and the reaction temperature T within a range of 51 $lg^2P$−38 lgP+800° C.<T<20 $lg^2P$+60 lgP+1050° C., a smelting reaction for magnesium is run, and in S4, with the absolute pressure P in the reactor being set within a range of 1000 Pa≤P≤atmospheric pressure or to a slightly positive pressure and the reaction temperature T within a range of 11 $lg^2P$+71 lgP+1210° C.<T<98 $lg^2P$−129 lgP+1300° C., a smelting reaction for calcium carbide is run.

In a Sixth Aspect, the Present Invention Also Provides a Method of Carbothermic Process of Metal Production Using Liquid-Phase Calcium Carbide as a Catalyst, Comprising the Steps of:

S1: preparing a granular raw material containing a metal oxide $M_mO$ and a granular carbon reducing agent, wherein the metal M in the metal oxide $M_mO$ is Mg, Pb, Sn, Zn, Fe, Mn, Ni, Co, Cr, Mo or V, and m is an atomic number ratio of metal element M to oxygen element O and m≤1;

S2: placing a calcium carbide catalyst within a reactor equipped with a heat source, heating and melting the calcium carbide so that it in a molten state forms a catalyst melt pool, and maintaining the melt pool at a temperature of 1900-2300° C.;

S3: a) mixing the granular raw material containing the metal oxide $M_mO$ with the granular carbon reducing agent and adding them to the catalyst melt pool to form a solid-phase material layer with a certain thickness over a surface of the catalyst melt pool; or b) first, laying a layer of the granular raw material containing the metal oxide $M_mO$ over a surface of the catalyst melt pool to form a first raw material layer, then laying a layer of the granular carbon reducing agent over the first raw material layer to form a first reduction layer, and following this order to stack sequentially a number of such layers; and S4: with an absolute pressure P in the reactor being set to a low vacuum pressure higher than a triple-point pressure of the metal M, atmospheric pressure or a slightly positive pressure, running a smelting reaction, during the reaction, through adjusting a thickness of the material layer in S3, causing a vapor of the metal M produced by the reaction to continually pass through the material layer and leave the material layer while remaining in a gaseous state, and obtaining a liquid simple substance of the metal M through condensation by a condenser connected to the reactor.

In some embodiments, preferably, a molar ratio of the metal oxide to the carbon reducing agent contained in all the material layer in S3 is $M_mO$:C≈1:1.

In some embodiments, preferably, when the oxide is magnesium oxide, in S4, with the absolute pressure P in the reactor being set within a range of 1000 Pa≤P≤atmospheric pressure or a slightly positive pressure, the smelting reaction is run, through adjusting thickness of the material layer in S3, a magnesium vapor produced by the reaction is caused to continually pass through the material layer and leave the material layer at a cooled temperature higher than a condensation temperature of the magnesium vapor $T_b$=21.4 $lg^2P$+18.4 lgP+437° C., and liquid magnesium is obtained through condensation by the condenser connected to the reactor.

The Present Invention Achieves the Technical Effects as Follows

1. With the methods disclosed in the present invention, liquid magnesium can be produced, completely eliminating the potential safety hazard of carbothermic magnesium production, i.e., the formation of a magnesium powder that may cause an explosion. Moreover, the liquid magnesium can be directly refined or cast into ingots, saving the cost of magnesium re-melting.

2. According to the present invention, co-production of calcium carbide (calcium acetylide) as a co-product can significantly increase the economic benefits of smelting production of magnesium and is also very superior in terms of environmental benefits because it does not lead to the generation of any solid waste. Therefore, it has a good prospect of industrial application.

3. According to the present invention, using solid phase calcium carbide as a catalyst for smelting production of magnesium or another metal can totally solve the reverse reaction problem associated with carbothermic smelting production. According to the present invention, when liquid-phase calcium carbide is used as a catalyst for smelting production of magnesium or another metal, reversing of the carbothermic smelting reaction occurs mainly during passage of the gaseous mixture of the metal vapor and CO through the solid-phase material layer. In this way, the overall efficiency of the reverse reaction is greatly lowered, and the reverse reaction problem associated with carbothermic smelting production can be substantially solved.

4. Compared with traditional aluminothermic calcium production, the carbothermic calcium production according to the present invention is much lower in calcium production cost and does not generate solid waste. Both the co-products, calcium carbide and carbon monoxide, can be effectively utilized and have significant economic value.

5. According to the present invention, compared with using solid phase calcium carbide as a catalyst, using liquid-phase calcium carbide as a catalyst for smelting production of magnesium or another metal saves pulverizing, pelletizing and other steps, simplifies the process and results in cost savings. Further, the reaction proceeds significantly faster in the liquid phase than in the solid phase, resulting in higher production efficiency.

6. The carbothermic process using calcium carbide as a catalyst according to the present invention can be used to smelt the oxides of many metals such as lead, tin, zinc, iron, manganese, nickel, cobalt, chromium, molybdenum and vanadium. In all these applications, a calcium carbide catalyzed reaction can be conducted first to produce a simple substance of the metal and calcium oxide, and the calcium oxide can then react with carbon to produce calcium carbide. Therefore, this approach has a wide range of applications and is low in smelting cost.

Below, the concept, structural details and resulting technical effects of the present invention will be further described with reference to the accompanying drawings to provide a full understanding of the objects, features and effects of the invention.

DETAILED DESCRIPTION OF THE PREFERRED EMBODIMENTS

Below, the accompanying drawings of this specification are referenced to introduce several technical contemplations and preferred embodiments of the present invention so that the techniques thereof become more apparent and readily understood. The present invention may be embodied in many different forms of technical contemplation and embodiment, and the protection scope of the invention is not limited only to the technical concepts and embodiments mentioned herein.

Figure 1:
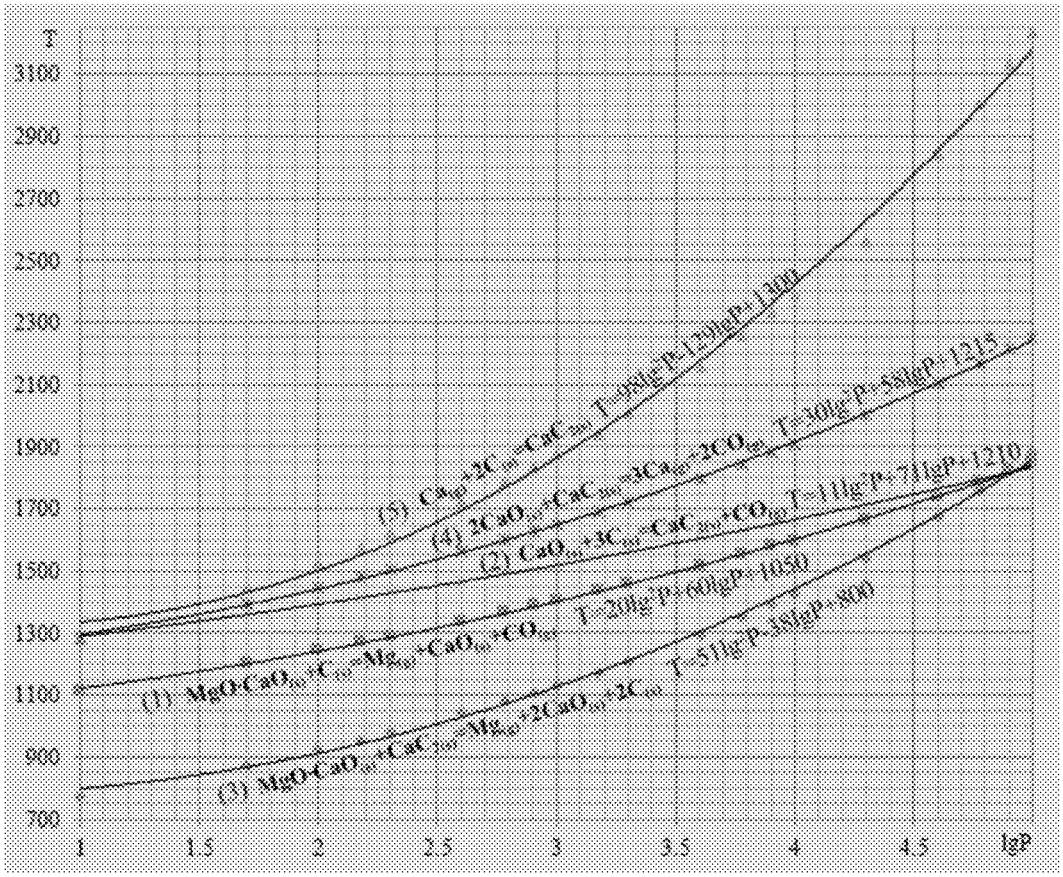
FIG. 1 shows curves representing temperature T (° C.)-absolute pressure P (Pa) relationships of relevant chemical reactions in a mixture of magnesium oxide, calcium oxide and carbon with calcium carbide, in which Curves (1) to (4) represent reactions that can occur at temperatures higher than the respective curves and Curve (5) represents a reaction that can occur at a temperature lower than the curve.

I. Technical Contemplation 1—Carbothermic Process of Magnesium Production and Co-Production of Calcium Carbide As shown in FIG. 1, at an absolute pressure P<100 Pa, i.e., when lgP<2, Curve (2) of the reaction $CaO_{(s)}+3C_{(s)}\rightarrow CaC_{2(s)}+CO_{(g)}$ is very close to Curve (4) of the reaction $2CaO_{(s)}+CaC_{2(s)}\rightarrow 3Ca_{(g)}+2CO_{(g)}$, indicating that it is difficult to enable, through reaction temperature control, only the $CaC_2$-producing reaction but not the Ca vapor-producing reaction to occur. Similarly, Curve (5) of the reaction $Ca_{(g)}+2C_{(s)}\rightarrow CaC_{2(s)}$ that occurs between vaporous Ca and C and produces $CaC_2$ is also very close to Curve (4), while the exothermic reaction $Ca_{(g)}+2C_{(s)}\rightarrow CaC_{2(s)}$ can occur only at a temperature lower than Curve (5), indicating that, in practice, once the Ca vapor-producing reaction $2CaO_{(s)}+CaC_{2(s)}\rightarrow 3Ca_{(g)}+2CO_{(g)}$ has started, it would become difficult to trigger the reaction $Ca_{(g)}+2C_{(s)}\rightarrow CaC_{2(s)}$ at a temperature lower than Curve (5). Consequently, the Ca vapor has to be lost in vain and is difficult to react with carbon to produce $CaC_2$. However, at an absolute pressure P≥1000 Pa, i.e., when lgP≥3, the distances between Curves (2), (4) and (5) are both expanded, making it relatively easy to control a reaction temperature within the range higher than Curve (2) and lower than Curve (4) and thus ensure that only the $CaC_2$-producing reaction occurs, but not the Ca vapor-producing reaction, takes place. Moreover, it also becomes relatively easy to control a reaction temperature within the range higher than Curve (2) and Curve (4) and lower than Curve (5) and thus ensure the occurrence of not only the $CaC_2$-producing reaction but also the subsequent reaction of the resulting Ca vapor with C. As a result, $CaC_2$ is produced, and the vapor will not be just lost. Of course, at this point, as the temperature is significantly higher than both Curves (1) and (3), there is no problem for vaporous magnesium to be produced.

FIG. 1 shows mathematical equations representing temperature T-absolute pressure P relationships of the reactions which have been regressed from experimental data and validated by thermodynamic calculations, in which the regression equation of Curve (2) for the reaction $CaO_{(s)}+3C_{(s)}\rightarrow CaC_{2(s)}+CO_{(g)}$ is approximated as $T=11\ lg^2P+71\ lgP+1210°$ C., and the regression equation of Curve (5) for the reaction $Ca_{(g)}+2C_{(s)}\rightarrow CaC_{2(s)}$ is approximated as $T=98\ lg^2P-129\ lgP+1300°$ C. At an absolute pressure P≥1000 Pa, as long as a reaction temperature T lies within the range of $11\ lg^2P+71\ lgP+1210°\ C.<T<98\ lg^2P-129\ lgP+1300°$ C., it can be ensured to produce vaporous magnesium and $CaC_2$ without a decrease in the yield of calcium carbide due to evaporative loss of calcium.

Figure 2:
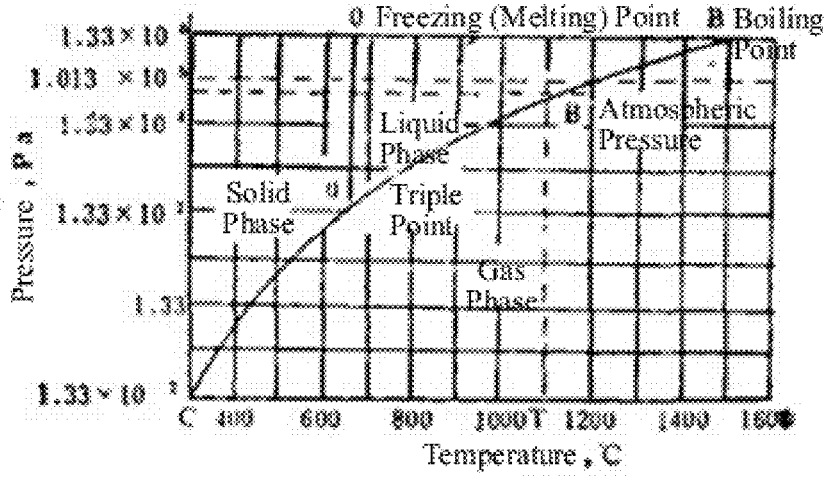
FIG. 2 shows a curve indicating transitions between three phases experienced by a magnesium vapor being cooled, which is given by existing literature.

Further, among the two major problems associated with carbothermic magnesium production, the safety problem arising from the formation of a magnesium powder during co-cooling of a magnesium vapor and a CO gas is the culprit that inhibits its industrial application (the reverse reaction problem that leads to a lower reduction rate and more impurities in the produced crude magnesium may be overcome by extending the reduction time, refining the crude magnesium or other supporting technical measures, so it is not considered as the primary factor that inhibits industrial application). Existing literature (see FIG. 2) and thermodynamic calculations (see FIG. 3) both suggest that, at an absolute pressure P≥1000 Pa, a magnesium vapor, when cooled, will directly condense into a solid phase without undergoing a liquid phase. Moreover, during the cooling, when co-existing with CO or another gas that does not condense, it is easy for the magnesium vapor to transition into a magnesium powder. However, at an absolute pressure P≥1000 Pa, cooling a magnesium vapor will first covert it into liquid magnesium which, when further cooled, will become crystalline magnesium in the form of a block rather than a magnesium powder. As graphite, silicon carbide and similar high-temperature resistant non-metallic materials are not able to maintain vacuum, traditional magnesium production techniques relying on thermal reduction all employed a reduction tank made of heat-resistant steel as a reactor. A service temperature of heat-resistant steel is typically not higher than 1200° C. Under such a temperature, an absolute pressure that allows effective smelting does not exceed 10-100 Pa. Therefore, in the traditional magnesium production techniques, a magnesium vapor cannot be cooled into liquid magnesium.

When an electric heating reactor is employed, a furnace feed material is held and smelted in a smelting chamber made of a high-temperature resistant material, and the smelting chamber is in turn contained in a hermetic container, with a thermal insulation layer being disposed between the hermetic container and the smelting chamber. An electric heating element directly or indirectly heats the smelting chamber and the furnace feed material within the thermal insulation layer, whilst the hermetic container is not subject to the high temperature and serves mainly to seal and isolate the inside of the reactor from outside air. As the high-temperature resistant material from which components of the smelting chamber are fabricated can resist a temperature up to 1500° C. or higher, a magnesium vapor is allowed to be present at an absolute pressure of 1000 Pa or higher, which enables the production of liquid magnesium. Thus, the safety problem arising from the generation of a magnesium powder can be totally circumvented, and the produced liquid magnesium can be directly refined or cast into ingots, saving the energy, labor and other cost involved in magnesium re-melting. The high-temperature resistant material may be selected from, among others, graphite, silicon carbide, molybdenum disilicide, tungsten, tungsten alloy, molybdenum, molybdenum alloy or high-temperature resistant ceramic.

Therefore, if a smelting chamber reactor made of a high-temperature resistant material is electrically heated in a hermetic container, and an absolute pressure P in the reactor is maintained in the range of 1000 Pa≤P≤atmospheric pressure or at a slightly positive pressure for carbothermic magnesium production, not only the energy consumed by a vacuum pump can be saved with efficient magnesium and $CaC_2$ production being achieved, but also the danger of an explosion caused by a magnesium powder during carbothermic magnesium production is completely avoided. Moreover, the produced liquid magnesium can be directly refined or cast into ingots, saving the cost of magnesium re-melting. In the context of the present invention, the "slightly positive pressure" refers to a positive pressure not 1000 Pa higher than the local atmospheric pressure.

The carbon reducing agent used in carbothermic magnesium production is coke, semi-coke, coal, petroleum coke, coal tar, graphite, asphalt or a mixture of any two or more of the above.

Example 1

Anthracite with a fixed carbon content of 90% was obtained from a coal mine, and dolomite ($MgCO_3 \cdot CaCO_3$) obtained from an ore mine was chemically analyzed. The results are shown in the table below.

Chemical Compositions of Dolomite Samples (w %)

| Sample No. | MgO | CaO | $SiO_2$ | $Al_2O_3$ | $Fe_2O_3$ | Burning Loss | Rest |
|---|---|---|---|---|---|---|---|
| 1 | 20.28 | 33.87 | 0.34 | 0.07 | 0.12 | 44.93 | 0.39 |
| 2 | 20.42 | 34.17 | 0.26 | 0.06 | 0.10 | 44.87 | 0.21 |
| Average | 20.35 | 34.02 | 0.30 | 0.07 | 0.11 | 44.90 | 0.30 |

In S1, after the dolomite was calcined into dolime in a rotary kiln, 100 kg of the dolime was weighed, which contained 36.93 kg of magnesium oxide (MgO) and 61.74 kg of calcium oxide (CaO), and 56.31 kg of anthracite was then weighed. The two were mixed and ground into 156.31 kg of a 100 mesh powder.

In S2, in a pellet mill, the aforementioned powder was pressed into a furnace feed material in the form of pillow-shaped pellets with dimensions of 50 mm (length)×30 mm (width)×20 mm (height). The material was placed into a graphite smelting chamber contained in a steel hermetic container. An electromagnetic induction coil was provided as a heat source outside the graphite smelting chamber, and a thermal insulation layer was disposed between the induction coil and the graphite smelting chamber. A shell and tube condenser was connected in series between an interface for a vacuum pipe on the top of the steel container and a vacuum pump, and a lower portion of the condenser was connected to a hermetic liquid magnesium reservoir.

In S3, through continuous vacuumization, an absolute pressure in the steel container was maintained at P≈3000 Pa, and the smelting chamber was heated to and maintained at a temperature T=1800±20° C. by electromagnetic induction. A smelting reaction carried on, and through an observation window in the liquid magnesium reservoir, liquid magnesium could be seen flowing from the condenser into the liquid magnesium reservoir. After 4 hours of the reaction, as indicated by a meter, electric heating power had undergone a significant decrease and showed a tendency toward a constant level. This indicated that the smelting reaction had substantially ended. Argon was introduced to eliminate the vacuum until a vacuum pressure meter on the reactor read zero. A waste discharge port at the bottom of the reactor was opened, and calcium acetylide pellets were discharged.

After being collected and weighed, 18.89 kg of crude magnesium and 89.05 kg of calcium acetylide pellets were produced. Chemical analysis results showed that the produced crude magnesium had a magnesium content of 98.5% and the calcium acetylide had a gas production capacity of 236 l/kg, which was equivalent to a calcium carbide content of 63%.

II. Technical Contemplation 2—Carbothermic Process of Calcium Production and Co-Production of Calcium Carbide As can be seen from FIG. 1, in the phase of the calcium carbide-producing reaction between carbon and calcium oxide: (1) if the temperature is in the range of $11\lg^2P+71\lg P+1210°$ C.$<T<30\lg^2P+58\lg P+1215°$ C., then only the reaction $CaO+3C \rightarrow CaC_2+CO$ will take place to produce $CaC_2$. (2) If the temperature is in the range of $30\lg^2P+58\lg P+1215°$ C.$<T<98\lg^2P-129\lg P+1300°$ C., then following the $CaC_2$-producing reaction $CaO+3C \rightarrow CaC_2+CO$, the reaction $2CaO+CaC_2 \rightarrow 3Ca+2CO$ will further occur to produce a calcium vapor. However, if a C/CaO molar ratio of the reaction system is ≥3, then the reaction $CaO+3C \rightarrow CaC_2+CO$ will first proceed completely, and there will be no CaO left to undergo the calcium-producing reaction $2CaO+CaC_2 \rightarrow 3Ca+2CO$ with $CaC_2$. As a result, the product of the system is $CaC_2$, and there will be no calcium vapor released from the reaction system. If the C/CaO molar ratio is <3, as the amount of carbon is not sufficient to support the adequate completion of the reaction $CaO+3C \rightarrow CaC_2+CO$, CaO will partially remain. The CaO remainder will undergo the calcium-producing reaction $2CaO+CaC_2 \rightarrow 3Ca+2CO$ with $CaC_2$. Consequently, there will be a reduced amount of $CaC_2$ in the system and a calcium vapor released from the reaction system. If the C/CaO molar ratio of the reaction system is ≤1, due to a too small amount of carbon in the system, the reaction $CaO+3C \rightarrow CaC_2+CO$ will be more inadequate, and the produced $CaC_2$ will be completely consumed in $2CaO+CaC_2 \rightarrow 3Ca+2CO$. Moreover, the produced calcium will be completely released from the reaction system due to the absence of carbon being left to undergo with it the reaction $Ca+2C \rightarrow CaC_2$. Finally, there will be no calcium carbide produced, and the only product is calcium. (3) If the temperature T is $>98\lg^2P-129\lg P+1300°$ C., only the two reactions $CaO+3C \rightarrow CaC_2+CO$ and $2CaO+CaC_2 \rightarrow 3Ca+2CO$ will occur successively. Due to the excessively high temperature, the reaction $Ca+2C \rightarrow CaC_2$ will not take place. In this case, even when there is a sufficient amount of carbon in the reaction system and the reaction proceeds adequately, finally only calcium but no calcium carbide will be produced.

The aluminothermic method is the current mainstream calcium production method, which involves using a calcium oxide powder as a raw material and an aluminum powder as a reducing agent, mixing and pelletizing them, producing a calcium vapor by carrying out the reduction reaction $6CaO+2Al \rightarrow 3Ca+3CaO \cdot Al_2O_3$ under vacuum at 1050-1200° C. and condensing the calcium vapor into crystalline calcium. Producing 1 ton of calcium consumes about 3 tons of calcium oxide and 0.5 tons of the aluminum powder and leads to the generation of about 2.5 tons of calcium aluminate as solid waste. This method is associated with high smelting cost and a risk of explosion due to the aluminum powder used.

If carbon is used as a reducing agent for calcium production, the reactions involved will be:

$$CaO + 3C \xrightarrow[\Delta]{} CaC_2 + CO$$

$$2CaO + CaC_2 \xrightarrow[\Delta]{} 3Ca + 2CO.$$

Combining these equations, we obtain $$CaO + C \xrightarrow[\Delta]{} Ca + CO.$$

In theory, producing 1 ton of calcium consumes only 1.4 tons of calcium oxide and 0.3 tons of carbon, and no solid waste will be generated. Estimated power consumption is about 5000 kWh/t. The smelting cost is approximately half that of the aluminothermic approach. Significant increases can be achieved in terms of economic benefits, environmental benefits and production safety.

Different ratios of CaO to C in the mixed powder will lead to different ratios of calcium to calcium carbide produced by the adequate smelting reaction. When the molar ratio CaO:C is ≈1:1, only calcium and CO will be produced, and there is substantially no calcium carbide produced. When the molar ratio CaO:C is ≈1:3, and at a reaction temperature Tin the range of $11\ \lg^2P+71\ \lg P+1210°$ C.$<T<98\ \lg^2P-129\ \lg P+1300°$ C., only calcium carbide and CO will be produced, and there is substantially no calcium produced. When the molar ratio CaO:C is within the range of 1:1 to 1:3, both calcium and calcium carbide will be produced.

Example 2

In S1, limestone was obtained from an ore mine, with a chemical composition as follows: CaO=54.0%, MgO=3.0%, $SiO_2$=1.5%, burning loss=41.4%, rest impurities=0.1%. Coke with a fixed carbon content of 85% was obtained from a coking plant. After the limestone was calcined into lime, 100 kg of the lime was weighed and used as a raw material, which contained 92.15 kg of calcium oxide. In case of only calcium to be produced without co-production of calcium carbide, 23.23 kg of the coke is added as a reducing agent resulting in a molar ratio CaO:C≈1:1. The two were mixed and ground into 123.23 kg of a 100 mesh mixed powder.

In S2, in a pellet mill, the aforementioned powder was pressed into a furnace feed material in the form of pillow-shaped pellets with dimensions of 50 mm (length)×30 mm (width)×20 mm (height). The material was placed into a graphite smelting chamber in a steel hermetic container. An electromagnetic induction coil was provided as a heat source outside the graphite smelting chamber, and a thermal insulation layer was disposed between the induction coil and the graphite smelting chamber. A shell and tube condenser was connected in series between an interface for a vacuum pipe on the top of the steel container and a vacuum pump, and a lower portion of the condenser was connected to a hermetic liquid calcium reservoir.

In S3, through continuous vacuumization, an absolute pressure in the steel container was maintained at P≈10000 Pa, and the smelting chamber was heated to and maintained at a temperature T=2000±20° C. by electromagnetic induction. A smelting reaction carried on, and through an observation window in the liquid calcium reservoir, liquid calcium could be seen flowing from the condenser into the liquid calcium reservoir. After 2.5 hours of the reaction, as indicated by a meter, electric heating power had undergone a significant decrease and showed a tendency toward a constant level. This indicated that the smelting reaction had substantially ended. Argon was introduced to eliminate the vacuum until a vacuum pressure meter on the reactor read zero. After a waste discharge port at the bottom of the reactor was opened, a small amount of solid waste was seen. Although the solid waste contained an insignificant amount of calcium carbide, it was of no value in terms of industrial use as calcium acetylide.

After being collected and weighed, 63.07 kg of crude calcium and 13.35 kg of solid waste were produced. Chemical analysis results showed that the produced crude calcium had a calcium content of 99.53% and the main impurity elements were Mg, Fe, etc. The main element components of the solid waste were C, Ca, Si, Al, etc.

III. Technical Contemplation 3—Carbothermic Process of Magnesium Production and Co-Production of Calcium Carbide Using Solid-Phase Catalyst In "Technical Contemplation 1" above, liquid magnesium is obtained through condensation by a condenser connected to the reactor without the formation of a magnesium powder, thereby eliminating the severe potential safety hazard in industrial carbothermic production. However, "Technical Contemplation 1" can only significantly suppress, but not totally prevent, the reversing of the smelting reaction between vaporous magnesium and CO. Therefore, "Technical Contemplation 1" still suffers from relatively low reduction rate of the magnesium production reaction and product purity.

Experimental research has found that the carbothermic magnesium production reaction $$MgO + C \xrightarrow[\Delta]{CaC_2} Mg + CO$$

obviously has a much higher magnesium production rate in the presence of $CaC_2$ than in the absence of $CaC_2$ in the system. Theoretical research shows that, when there is sufficient $CaC_2$ in the system, under certain conditions, the magnesium production reaction $$MgO + C \xrightarrow[\Delta]{CaC_2} Mg + CO$$

consists of two steps:

$$MgO + CaC_2 \xrightarrow[\Delta]{} Mg + 2C + CaO \text{ and}$$
$$CaO + 3C \xrightarrow[\Delta]{} CaC_2 + CO,$$

in which $CaC_2$ serves as a catalyst. The reaction between MgO and $CaC_2$ in the first step produces a magnesium vapor as the only gas product, and the reaction between CaO and C in the second step produces CO as the only gas product. Therefore, when these gases are released immediately after being produced, co-existence of the magnesium vapor and CO in the reactor will not take place, thus avoiding the occurrence of the reverse reaction $Mg_{(g)}+CO_{(g)}\rightarrow MgO_{(s)}+C_{(s)}$. Moreover, it is not possible for a magnesium powder to be formed during the production of the liquid. Further, theoretically, the produced $CaC_2$ is equal in amount to the $CaC_2$ catalyst added to the raw material, and can be recycled as the catalyst for the next smelting cycle. Therefore, the use of the catalyst will not increase the smelting cost. Similarly, when dolime (MgO·CaO) is used as a raw material, the reaction $$MgO \cdot CaO + 4C \xrightarrow[\Delta]{CaC_2} Mg + 2CO + CaC_2$$

can be decomposed into two steps:

$$MgO \cdot CaO + CaC_2 \xrightarrow[\Delta]{} Mg + 2C + 2CaO \text{ and}$$
$$CaO + 3C \xrightarrow[\Delta]{} CaC_2 + CO,$$

and the produced $CaC_2$ is twice as much as that produced with MgO being used as a raw material. Accordingly, one half of it can be reused as a catalyst, and the other half can be sold as calcium acetylide. This can greatly increase economic benefits from magnesium production.

As can be seen from FIG. 1, in the reaction system of magnesium oxide and calcium oxide with C, if there is a sufficient amount of $CaC_2$, then when the reaction temperature is kept lower than Curve (1) but higher than Curve (3), the reaction $MgO\cdot CaO_{(s)}+C_{(s)}\rightarrow Mg_{(g)}+CO_{(g)}+CaO_{(s)}$ of Curve (1) will not take place, and only the reaction $MgO\cdot CaO_{(s)}+CaC_{2(s)}\rightarrow Mg_{(g)}+2C_{(s)}+2CaO_{(s)}$ of Curve (3) will occur. Consequently, only vaporous Mg, C and CaO but no CO will be produced. Since the exothermic reaction $Ca_{(g)}+2C_{(s)}\rightarrow CaC_{2(s)}$ only occurs at a temperature lower than Curve (5), after the smelting reaction of Curve (3) for magnesium production has completed, if the smelting process is continued with the temperature being raised to a value higher than Curve (2) but lower than Curve (5), then the reaction $CaO_{(s)}+3C_{(s)}\rightarrow CaC_{2(s)}+CO_{(g)}$ of Curve (2), the reaction $2CaO_{(s)}+CaC_{2(s)}\rightarrow 3Ca_{(g)}+2CO_{(g)}$ of Curve (4) and the reaction $Ca_{(g)}+2C_{(s)}\rightarrow CaC_{2(s)}$ of Curve (5) will occur to produce $CaC_2$ and CO, without the problem of loss of calcium in the form of a vapor. In other words, if enough $CaC_2$ is added to the carbothermic magnesium production reaction system of magnesium oxide and calcium oxide with C and the reaction process is decomposed into two steps respectively for producing magnesium and calcium carbide, i.e., (1) the initial magnesium production step run at a temperature maintained within the range of $51\ \lg^2P-38\ \lg P+800°\ C.<T<20\ \lg^2P+60\ \lg P+1050°\ C.$, then only one gas, i.e., a magnesium vapor, will be produced, without the occurrence of the reverse reaction between the magnesium vapor and CO, and liquid magnesium will be produced when an absolute pressure P is further maintained ≥1000 Pa, without a hazard of explosion due the formation of a magnesium powder;

(2) the subsequent $CaC_2$ production step run at a temperature maintained within the range of $11\ \lg^2P+71\ \lg P+1210°\ C.<T<98\ \lg^2P-129\ \lg P+1300°\ C.$ and producing CO, then loss of calcium in the form of a vapor and hence a decrease in the yield of $CaC_2$ will not happen.

Example 3

In S1, the same anthracite and dolomite as Example 1, calcium acetylide with a gas production capacity of 300 l/kg (a $CaC_2$ content of 80%) and high-temperature pitch with a fixed carbon content of 80% were used. After the dolomite was calcined into dolime in a rotary kiln, 100 kg of the dolime was weighed, which contained 36.93 kg of magnesium oxide (MgO) and 61.74 kg of calcium oxide (CaO). Theoretically, 50.69 kg of pure carbon was needed, in order to facilitate palletizing, 80% of which was provided by the anthracite and 20% by the pitch. 45.06 kg of the anthracite, 12.67 kg of the pitch and 73.31 kg of the calcium acetylide were weighed. The 100 kg of dolime was mixed with the anthracite, the pitch and the calcium acetylide, and the mixture was then ground into 231.45 kg of a 100 mesh powder.

In S2, in a pellet mill, the aforementioned powder was pressed into a furnace feed material in the form of pillow-shaped pellets with dimensions of 50 mm (length)×30 mm (width)×20 mm (height). The material was placed into a graphite smelting chamber in a steel hermetic container. An electromagnetic induction coil was provided as a heat source outside the graphite smelting chamber, and a thermal insulation layer was disposed between the induction coil and the graphite smelting chamber. A shell and tube condenser was connected in series between an interface for a vacuum pipe on the top of the steel container and a vacuum pump, and a lower portion of the condenser was connected to a hermetic liquid magnesium reservoir.

In S3, through continuous vacuumization, an absolute pressure in the steel container was maintained at P≈2000 Pa, and the smelting chamber was heated to and maintained at a temperature T=1450±20° C. by electromagnetic induction. A smelting reaction for magnesium production carried on, and through an observation window in the liquid magnesium reservoir, liquid magnesium could be seen flowing from the condenser into the liquid magnesium reservoir.

In S4, after about 1 hour of the aforementioned reaction, as indicated by a meter, electric heating power had undergone a significant decrease and showed a tendency toward a constant level. This indicated that the smelting reaction for magnesium production had substantially ended. After that, with the pressure in the steel container being maintained, the temperature in the smelting chamber was increased to T=1750-1800° C. to allow a smelting reaction for calcium carbide production to proceed. After about 2 hours of this reaction, heating power again experienced a decrease and showed a tendency toward a constant level, indicating the smelting reaction for calcium carbide production had substantially ended. Argon was introduced to eliminate the vacuum until a vacuum pressure meter on the reactor read zero. A waste discharge port at the bottom of the reactor was opened, and calcium acetylide pellets were discharged.

This apparatus operated in production cycles of about 3 hours. In each cycle, 20.96 kg of crude magnesium and 89.9 kg of calcium acetylide (not including the calcium carbide added as a catalyst) were produced. Chemical analysis results showed that the crude magnesium has a magnesium content of 99.93% and the calcium acetylide pellets had a gas production capacity of 241 l/kg, which was equivalent to a calcium carbide content of about 64%. In average, per hour, about 7 kg/h of magnesium and about 15 kg/h of pure calcium carbide (not including that added as a catalyst) were produced.

IV. Technical Contemplation 4—Carbothermic Process of Magnesium Production and Co-Production of Calcium Carbide Using Liquid-Phase Catalyst In "Technical Contemplation 3" above, it is necessary to first grind the raw material, the reducing agent and the catalyst into a powder and press the powder into pellets and then to feed the pellets into the reactor so that smelting is accomplished by a solid-phase reaction. In general terms, a solid-phase reaction proceeds much more slowly than a liquid-phase reaction. In addition, the pulverizing and pelletizing steps extend the process and raise its cost.

Pure $CaC_2$ has a melting point of about 2300° C. By containing various percentages of CaO, the melting point of calcium acetylide can drop up to about 1800-1900° C. Experiments have found that, when MgO blocks are put into a calcium acetylide melt pool in a molten state, a large amount of vaporous magnesium and gaseous CO will be produced soon. When MgO·CaO blocks are put into a calcium acetylide melt pool, in addition to a large amount of vaporous magnesium and gaseous CO that will be produced soon, a small amount of vaporous calcium will also be produced, and liquid $CaC_2$ will gradually grow in amount in the melt pool. If small blocks of MgO·CaO raw material and small coke blocks that are alternately laid in layers (or mixed coke and raw material blocks) are laid over a surface of a calcium acetylide melt pool surface (part of which will be submerged below the surface, while the rest will remain above the surface), in case of a large thickness of the material layers above the surface, gases discharged from the top of the material layers of blocks will be only vaporous magnesium and CO. In case of a small thickness of the material layers above the surface, in addition to a large amount of vaporous magnesium and CO, a small amount of vaporous calcium will be also discharged from the top of the material layers of blocks. Further, the amount of the discharged vaporous calcium can be adjusted by changing the thickness of the material layers.

As can be found from an analysis of FIG. 1, when MgO·CaO blocks and C blocks are put into molten $CaC_2$, the reaction $$MgO \cdot CaO_{(s)} + CaC_{2(l)} \xrightarrow[\Delta]{} Mg_{(g)} + 2C_{(s)} + 2CaO_{(s)}$$

will first take place. With free C being formed in the melt, the reactions $MgO{\cdot}CaO_{(s)}+C_{(s)}\rightarrow Mg_{(g)}+CO_{(g)}+CaO_{(s)}$ and $2CaO_{(s)}+CaC_{2(s)}\rightarrow 3Ca_{(g)}+2CO_{(g)}$ will also occur to certain extents. However, the latter two reactions (especially the last one) are mild and provide a small amount of vaporous calcium and CO (compared to the amount of vaporous magnesium produced). When passing through the material layers of blocks, the vaporous calcium will undergo the reaction $Ca_{(g)}+2C_{(s)}\rightarrow CaC_{2(s)}$ with C at the surface of carbon blocks. When the carbon layers of blocks are thick enough, no vaporous calcium will be discharged from the top of the material layers. After MgO in the melt pool is completely consumed, the reaction $CaO_{(l)}+3C_{(s)}\rightarrow CaC_{2(l)}+CO_{(g)}$ between CaO and C will start, and as this reaction proceeds, an increasing amount of $CaC_2$ will be present in the melt pool. Because of a higher temperature and faster diffusion of reactants in molten $CaC_2$, especially when both CaO and $CaC_2$ are in a molten state, the reaction $CaO_{(l)}+3C_{(s)}\rightarrow CaC_{2(l)}+CO_{(g)}$ in the melt pool proceeds much faster than the solid-phase reaction $CaO_{(s)}+3C_{(s)}\rightarrow CaC_{2(s)}+CO_{(g)}$. That is, the carbon reduction reaction $$MgO \cdot CaO + 4C \xrightarrow[\Delta]{CaC_2} Mg + 2CO + CaC_2$$

for magnesium production proceeds much faster under liquid-phase catalysis than under solid-phase catalysis.

Figure 3:
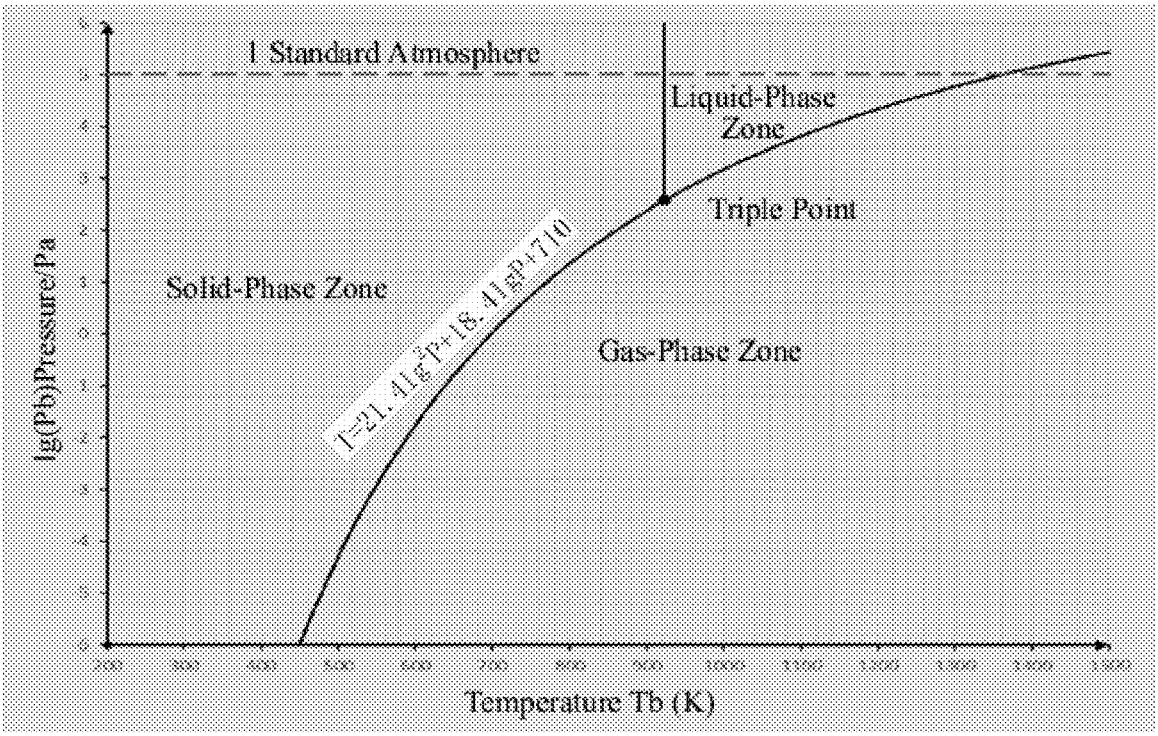
FIG. 3 shows a curve indicating transitions between three phases experienced by a magnesium vapor being cooled, which is plotted based on thermodynamic calculations.
Figure 4:
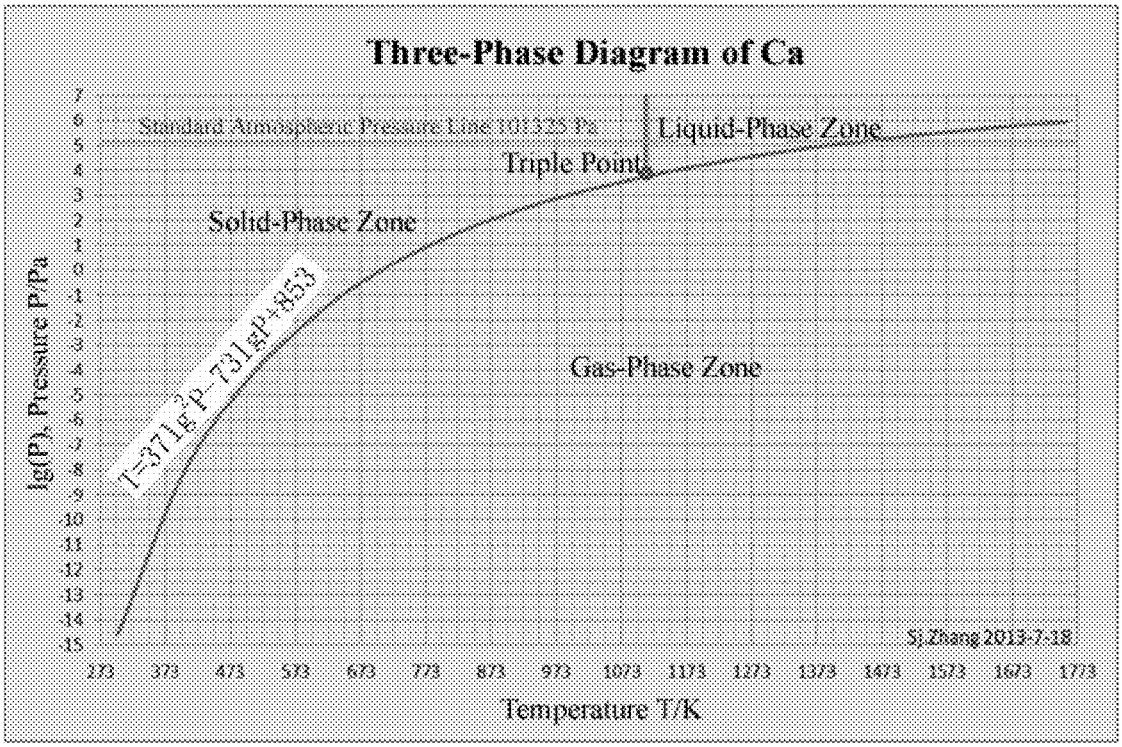
FIG. 4 shows a curve indicating transitions between three phases experienced by a calcium vapor being cooled, which is plotted based on thermodynamic calculations.

As can be seen from FIGS. 1, 3 and 4, at a molten state of $CaC_2$, i.e., at a melt pool temperature T>1900° C. and a pressure P in the range of 1000 Pa≤P<10000 Pa, through properly configuring the thickness of the material layers (according to specific values of the reaction temperature and absolute pressure), the magnesium vapor can be controlled so as to leave the material layers at a temperature T lower than $T=98\ \lg^2P-129\ \lg P+1300°$ C. and slightly higher than a condensation temperature of the magnesium vapor, $T_b=21.4\ \lg^2P+18.4\ \lg P+437°$ C. That is, the magnesium vapor is controlled so as to leave the material layers at a temperature T in the range of $7812.6/(11.8-\lg P)-273°$ C.$<T<98\ \lg^2P-129\ \lg P+1300°$ C. As a result, liquid magnesium can be obtained by condensation of the magnesium vapor. However, in this case, there may be a small amount of vaporous calcium lost together with gaseous CO. In contrast, at a pressure P≥10000 Pa, through controlling the melt pool temperature as $T \leq 30\ lg^2P+58\ lgP+1215°$ C. and causing the magnesium vapor to leave the material layers at a temperature T slightly higher than $T=21.4\ lg^2P+18.4\ lgP+437°$ C., liquid magnesium can be obtained by condensation of the magnesium vapor and reversing of the smelting reaction can be substantially eliminated, without any loss of vaporous calcium. Similarly, at a pressure $P \geq 10000$ Pa, if the melt pool temperature T is $>30\ lg^2P+58\ lgP+1215°$ C. and the magnesium vapor leaves the material layers at a temperature $T>37\ lg^2P-73\ lgP+580°$ C. (condensation temperature of vaporous calcium), both liquid magnesium and a minor amount of liquid calcium can be obtained through condensation, without loss of vaporous calcium.

Example 4

In S1, the same dolomite as Example 1 with a particle size of 20-50 mm was used and calcined into dolime in a rotary kiln. Each ton of the dolime contained 369.3 kg of magnesium oxide and 617.4 kg of calcium oxide. Semi-coke with a particle size of 10-20 mm and fixed carbon content of 82% was obtained from a semi-coke plant. Calcium acetylide with a gas production capacity of 300 l/kg (a $CaC_2$ content of 80%) was obtained from a calcium acetylide plant. According to a calculation, each ton of the dolime was added with 618.2 kg of the semi-coke. That is, a mass ratio of the dolime to the semi-coke was 1:0.6182.

In S2, the calcium acetylide was placed into a graphite smelting chamber of a resistively heated hermetic steel reactor and then heated and melted therein, resulting in the formation of a calcium acetylide melt pool with a depth of about 300 mm.

In S3, dolime particles and semi-coke particles were homogenously mixed according to the aforementioned dolime/semi-coke mass ratio, i.e., 1:0.6182, and added to the melt pool, until an about 500 mm thick unsubmerged material layer emerged above a surface of the melt pool.

In S4, with an absolute pressure P in the reactor being set as ≈20000 Pa and a temperature of the melt pool being maintained at T=2000±20° C. through adjusting electric heating power, a smelting reaction was run. Meanwhile, the thickness of the material layer was adjusted by material addition so that a magnesium vapor produced left the material layer at a temperature of about 1000° C. The magnesium vapor entered a condenser connected in series to the reactor and condensed there into liquid magnesium. During the smelting process, once the surface of the melt pool rose beyond a control level, it was discharged from a liquid discharge port in the reactor. After the discharged liquid calcium carbide condensed, it could be sold as a co-product.

In average, per hour, this method produced about 13 kg/h of pure magnesium and about 33 kg/h of pure calcium carbide. The production efficiency was about twice that of the solid-phase catalysis approach. The crude liquid magnesium immediately from condensation had a magnesium content of about 95%, the calcium acetylide obtained after the liquid calcium carbide was cooled had a gas production capacity of 270 l/kg, which was equivalent to a calcium carbide content of about 72%. The quality of the crude magnesium was lower than that obtained by the solid-phase approach, but the quality of the calcium acetylide was higher than that obtained by the solid-phase approach.

V. Technical Contemplation 5—Carbothermic Process of Production of Multiple Metals Using Solid-Phase Calcium Carbide Catalyst Studies have found that, not only carbothermic magnesium production from a mixture of magnesium oxide and calcium oxide using calcium carbide as a catalyst is possible, oxides $M_mO$ (m represents a ratio of metal atoms to oxygen atoms) of many metals such as Mg, Pb, Sn, Zn, Fe, Mn, Ni, Co, Cr, Mo and V (hereinafter, collectively denoted as M) can react with calcium carbide to produce simple substances of the metals and calcium oxide, and the produced calcium oxide can also further react with carbon to again produce calcium carbide. These smelting reactions can be collectively expressed as the following equations:

$$M_mO + CaC_2 \xrightarrow[\Delta]{} mM + CaO + 2C$$

$$CaO + 3C \xrightarrow[\Delta]{} CaC_2 + CO$$

Combining the above two equations, we obtain $$M_mO + C \xrightarrow[\Delta]{CaC_2} mM + CO.$$

Figure 5:
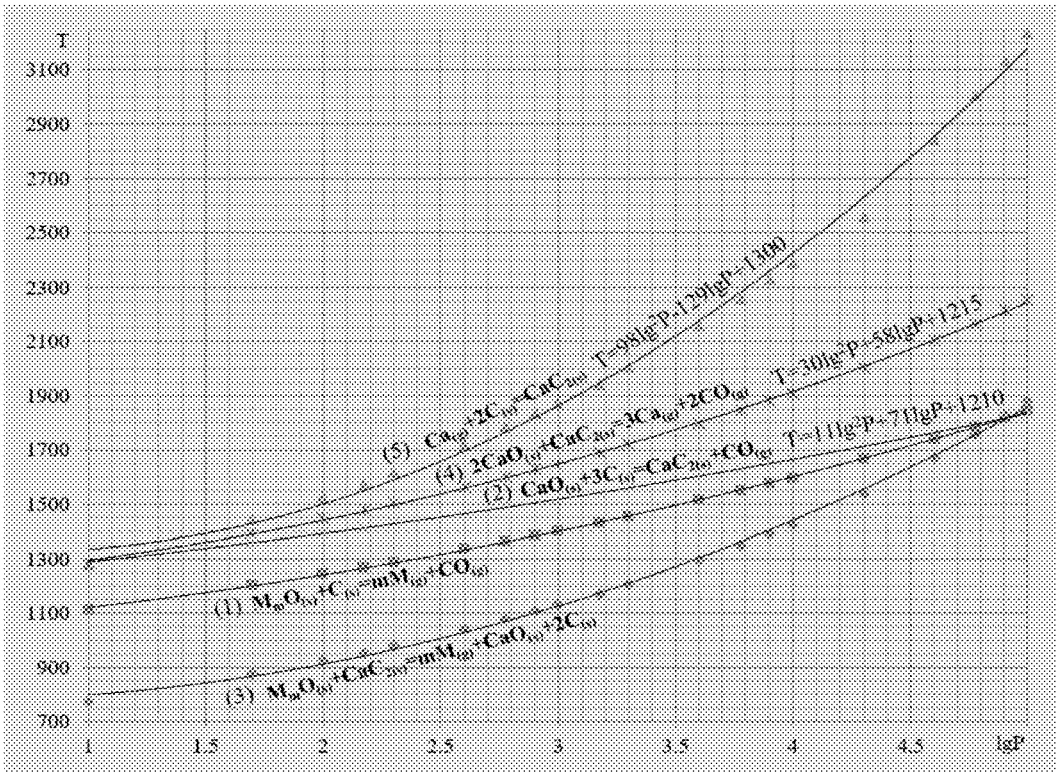
FIG. 5 shows curves representing temperature T (° C.)-absolute pressure P (Pa) relationships of relevant chemical reactions involved in a carbothermic process for smelting an oxide $M_mO$ of a metal M using $CaC_2$ as a catalyst to produce a simple substance of the metal M according to a preferred embodiment, in which Curves (1) and (3) are schematic qualitative curves of reduction reactions of the metal oxide $M_mO$, Curves (1) to (4) represent reactions that can occur at temperatures higher than the respective curves and Curve (5) represents a reaction that can occur at a temperature lower than the curve.

It can be seen that $CaC_2$ serves as a catalyst in the reactions. The thermodynamic laws of the chemical reactions are qualitatively described in FIG. 5.

Thus, using the same method as described above, which uses a mixture of magnesium oxide and calcium oxide as a raw material, carbon as a reducing agent and calcium carbide as a catalyst for magnesium production, oxides of metals such as magnesium, lead, tin, zinc, iron, manganese, nickel, cobalt, chromium, molybdenum and vanadium can be smelted to produce simple substances of the metals. In each production cycle, substantially the same amount of calcium carbide as that of the added calcium carbide catalyst can be produced and reused in its entirety as a catalyst.

Example 5

In S1, first-grade magnesite was obtained from an ore mine, with a chemical composition as follows: MgO=46%, CaO=0.6%, $SiO_2$=1.0%. First-grade calcium acetylide with a $CaC_2$ content of 80% was obtained from a calcium acetylide plant, and high-temperature pitch with a fixed carbon content of 80% was obtained from a chemical plant. To 100 kg of calcined magnesite containing 96.64 kg of the active ingredient MgO, 191.84 kg of the calcium acetylide and 35.97 kg of the pitch were added. They were then mixed and ground to 327.81 kg of a 100 mesh mixed powder.

In S2, the aforementioned mixed powder was pressed pillow-shaped pellets with dimensions of 50 mm (length)×30 mm (width)×20 mm (height), and the pellets were placed into a graphite smelting chamber contained in a steel hermetic container. The graphite smelting chamber was resistively heated, and a thermal insulation layer was disposed between the smelting chamber and the steel container. A shell and tube condenser was connected in series between an interface for a vacuum pipe on the top of the steel container and a vacuum pump, and a lower portion of the condenser was connected to a hermetic liquid magnesium reservoir.

In S3, with an absolute pressure P in the reactor being set as P≈1000 Pa and a temperature in the smelting chamber being maintained at T=1400±20° C. through adjusting electric heating power, a smelting reaction for magnesium production was run. Through an observation window in the liquid magnesium reservoir, liquid magnesium could be seen flowing from the condenser into the liquid magnesium reservoir.

In S4, after about 2 hours of the aforementioned smelting reaction for magnesium production, electric heating power had undergone a significant decrease and showed a tendency toward a constant level, indicating that the smelting reaction for magnesium production had substantially ended. After that, with the absolute pressure P in the reactor being set as ≈3000 Pa, the temperature in the smelting chamber was increased to T=1750±20° C. to allow a smelting reaction for calcium carbide production to proceed. After about 1 hour of this reaction, heating power again experienced a decrease and showed a tendency toward a constant level, indicating the smelting reaction for calcium carbide production had substantially ended. Argon was introduced to eliminate the vacuum until a vacuum pressure meter on the reactor read zero. A waste discharge port at the bottom of the reactor was opened, and the produced calcium acetylide was discharged and used as a reducing agent for the next production cycle.

This method operated in production cycles of about 3 hours. In each cycle, 68.56 kg of crude magnesium was produced. In average, per hour, about 22 kg/h of magnesium was produced. The crude magnesium had a magnesium content of 99.96%.

VI. Technical Contemplation 6—Carbothermic Process of Production of Multiple Metals Using Liquid-Phase Calcium Carbide Catalyst In the method as described above in "Technical Contemplation 5" for carbothermic production of multiple metals, if liquid-phase $CaC_2$ is instead used as the catalyst, not only much faster smelting reaction speeds can be achieved, but also the pulverizing, pelletizing and other steps can be saved, resulting in increased production efficiency, a shortened process flow and reduced product cost.

Example 6

In S1, the same magnesite as Example 5 with a particle size of 20-50 mm was used and calcined. Each ton of the calcined magnesite contained 966.4 kg of magnesium oxide. Coke with a particle size of 10-20 mm and a fixed carbon content of 85% was obtained from a coke plant, and calcium acetylide with a gas production capacity of 300 l/kg (a $CaC_2$ content of 80%) was obtained from a calcium acetylide plant. Each ton of the calcined magnesite was added with 338.5 kg of the coke. That is, a mass ratio of the calcined magnesite to the coke was 1:0.3385.

In S2, the calcium acetylide was placed into a graphite smelting chamber of a resistively heated hermetic steel reactor and then heated and melted therein, resulting in the formation of a calcium acetylide melt pool with a depth of about 300 mm.

In S3, calcined magnesite particles and coke particles were homogenously mixed according to the aforementioned calcined magnesite/coke mass ratio, i.e., 1:0.3385, and added to the catalyst melt pool in the smelting chamber, until an about 500 mm thick unsubmerged material layer emerged above a surface of the melt pool.

In S4, with an absolute pressure P in the reactor being set as P≈20000 Pa and a temperature of the melt pool being maintained at T=2000±20° C. through adjusting electric heating power, a smelting reaction was run. Meanwhile, the thickness of the material layer was adjusted by material addition so that a magnesium vapor produced left the material layer at a temperature of about 1000° C. The magnesium vapor entered a condenser connected in series to the reactor and condensed there into liquid magnesium.

In average, per hour, this method produced an equivalent amount of about 40 kg/h of pure magnesium. The production efficiency was about twice that of the solid-phase catalysis approach. The liquid magnesium immediately from condensation had a magnesium content of about 95%. The quality of the crude magnesium was lower than that obtained by the solid phase approach.

Technical contemplations and preferred specific embodiments have been described in detail above. It is to be understood that, those of ordinary skill in the art, without the need for creative effort, can make various modifications and changes, based on the concept of the present invention. Accordingly, all the technical solutions that can be obtained by those skilled in the art by logical analysis, inference or limited experimentation in accordance with the concept of the invention on the basis of the prior art are intended to fall within the protection scope as defined by the claims.

The invention claimed is:

1. A carbothermic process of magnesium production and co-production of calcium carbide, comprising steps of:

S1: preparing a mixed powder containing magnesium oxide, calcium oxide and a carbon reducing agent;

S2: processing the mixed powder into a pelletized furnace feed material and placing it into a reactor equipped with a heat source; and S3: with an absolute pressure P in the reactor being set within a range of 1000 Pa≤P≤a slightly positive pressure and a reaction temperature T within a range of $30\lg^2P+58\lg P+1215°$ C.$<T<98\lg^2P-129\lg P+1300°$ C., running a smelting reaction, and obtaining liquid magnesium through condensation by a condenser connected to the reactor and the calcium carbide within the reactor;

wherein the slightly positive pressure refers to a positive pressure not 1000 Pa higher than a local atmospheric pressure;

wherein the smelting reaction produces a calcium vapor that always reacts with the carbon reducing agent to produce the calcium carbide.

2. The carbothermic process of claim 1, wherein the mixed powder has a degree of fineness of 80 mesh or greater.

3. The carbothermic process of claim 1, wherein the pelletized furnace feed material has an equivalent diameter of 20 mm to 40 mm.

4. The carbothermic process of claim 1, wherein: an outer layer of the reactor is a hermetic container provided therein with a smelting chamber, with a thermal insulation layer being disposed between the hermetic container and the smelting chamber; and the pelletized furnace feed material is placed within the smelting chamber.

5. The carbothermic process of claim 4, wherein the smelting chamber is constructed from components of a high-temperature resistant material that is resistant to a temperature not lower than 1700° C.

6. The carbothermic process of claim 5, wherein the high-temperature resistant material is graphite, silicon carbide, molybdenum disilicide, tungsten, tungsten alloy, molybdenum, molybdenum alloy or high-temperature resistant ceramic.

7. The carbothermic process of claim 1, wherein the carbon reducing agent is coke, semi-coke, coal, petroleum coke, coal tar, graphite, asphalt or a mixture of any two or more of the above.

8. The carbothermic process of claim 1, wherein a heating manner of the heat source is electric heating.

* * * * *